US007360277B2

(12) United States Patent
Moshenrose et al.

(10) Patent No.: US 7,360,277 B2
(45) Date of Patent: Apr. 22, 2008

(54) VACUUM CLEANER FAN UNIT AND ACCESS APERTURE

(75) Inventors: Paul A. Moshenrose, Ocean Springs, MS (US); Charles W. Reynolds, Long Beach, MS (US); Christopher M. Paterson, Biloxi, MS (US); Steve Irby, Gulfport, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 488 days.

(21) Appl. No.: 10/808,062

(22) Filed: Mar. 24, 2004

(65) Prior Publication Data

US 2005/0210628 A1 Sep. 29, 2005

(51) Int. Cl.
*A47L 9/00* (2006.01)

(52) U.S. Cl. ..... 15/412; 15/415.1
(58) Field of Classification Search ..... 15/412, 15/350, 415.1, 351, 340.1
See application file for complete search history.

(56) References Cited

U.S. PATENT DOCUMENTS

| | | | | | |
|---|---|---|---|---|---|
| 2,103,054 | A | * | 12/1937 | Becker | 15/412 |
| 2,345,452 | A | * | 3/1944 | Boyer | 15/412 |
| 2,359,194 | A | * | 9/1944 | Becker | 15/412 |
| 2,657,417 | A | * | 11/1953 | Howard | 15/412 |
| 2,730,750 | A | * | 1/1956 | La Briere | 15/412 |
| 2,763,025 | A | * | 9/1956 | Segesman | 15/412 |
| 3,199,138 | A | * | 8/1965 | Nordeen | 15/350 |

* cited by examiner

*Primary Examiner*—Theresa T. Snider
(74) *Attorney, Agent, or Firm*—The Ollila Law Group LLC

(57) ABSTRACT

A vacuum cleaner according to an embodiment of the invention includes a chassis, a fan unit including a blower housing mounted to the chassis and an inlet housing affixed to the blower housing, and a baseplate affixed to the chassis. An access aperture is formed in the baseplate. The access aperture extends at least partially over the fan unit. A door can be included in the baseplate. A bearing washer is positioned between the blower housing and the inlet housing and provides a substantially air-tight seal between the blower housing and the inlet housing. The inlet housing includes a bearing face, an inlet conduit portion, a slide flange, and a slide block. The slide block slides into and engages the slide flange and further slides into and engages the chassis of the vacuum cleaner.

22 Claims, 16 Drawing Sheets

VACUUM CLEANER FAN UNIT AND ACCESS APERTURE

TECHNICAL FIELD

The present invention relates to a vacuum cleaner, and more particularly, to a vacuum cleaner fan unit and an access aperture.

BACKGROUND OF THE INVENTION

A vacuum cleaner works by creating an airflow that can be directed to pick up dirt and debris. The airflow is typically created by a fan unit that includes a motor and an impeller. The dirt and debris in the airflow is filtered out and trapped in a bag for disposal.

The fan unit is usually in the interior of the vacuum cleaner mechanism, and is relatively difficult to access. In the prior art, accessing the fan unit is typically difficult and time-consuming. For example, it is common to need to remove multiple fasteners and one or more panels (or other components) in order to access the fan unit. Then, removal of all or part of the fan unit in the prior art can additionally require removal of multiple fasteners and multiple parts.

Access to and disassembly of the fan unit of a vacuum cleaner can be necessary for several reasons. The fan unit can require access for cleaning or unclogging of the fan unit (or any ducting leading to the fan unit). This is necessary in vacuum cleaners where the dirt-laden airflow passes through the fan unit. In addition, the fan unit can require access for inspection, service or replacement of components.

SUMMARY OF THE INVENTION

A vacuum cleaner according to an embodiment of the invention comprises a chassis, a blower housing mounted to the chassis, an inlet housing removably affixed to the blower housing, and a baseplate affixed to the chassis and including an access aperture formed in the baseplate. The access aperture extends at least partially over the inlet housing and the inlet housing can be accessed through the access aperture.

A vacuum cleaner is provided according to an embodiment of the invention. The vacuum cleaner comprises a chassis, a blower housing mounted to the chassis, an inlet housing removably affixed to the blower housing, and a baseplate affixed to the chassis and including an access aperture formed in the baseplate. The access aperture extends at least partially over the inlet housing and the inlet housing can be accessed through the access aperture. The vacuum cleaner further comprises a door including open and closed positions, with the door substantially blocking the access aperture when in the closed position, and two or more fastener devices that removably affix the door to the baseplate when the door is in the closed position.

A vacuum cleaner fan unit is provided according to an embodiment of the invention. The vacuum cleaner fan unit comprises a blower housing adapted to receive an impeller, an inlet housing including an inlet conduit portion and with the inlet housing closing the blower housing when the inlet housing is assembled to the blower housing, and a bearing washer positioned between the blower housing and the inlet housing. The bearing washer provides a substantially airtight seal between the blower housing and the inlet housing.

An inlet housing adapted for a vacuum cleaner fan unit is provided according to an embodiment of the invention. The inlet housing comprises a bearing face adapted to receive a bearing washer that is positioned between the inlet housing and the blower housing when the inlet housing is assembled to the blower housing, an inlet conduit portion extending from the inlet housing and admitting an airflow, a slide flange formed on an end of the inlet conduit portion, with the slide flange including at least one rib, and a slide block that slides into and engages the slide flange and further slides into and engages the chassis. The slide block includes at least one groove corresponding to the at least one rib of the slide flange. When the slide block slides into and engages the slide flange the at least one rib engages the at least one groove, wherein the slide block removably affixes the inlet housing to the chassis at a first location.

A bearing washer adapted to fit between an inlet housing and a blower housing of a vacuum cleaner fan unit is provided according to an embodiment of the invention. The bearing washer comprises a substantially circular disc having a thickness, an outer diameter, and an inner aperture of an inner diameter, with the disc being formed of a compressible material, and one or more cutouts positioned along the inner aperture and adapted to receive alignment ribs of the inlet housing.

BRIEF DESCRIPTION OF THE DRAWINGS

The same reference number represents the same element on all drawings. It should be noted that the drawings are not to scale.

DETAILED DESCRIPTION OF THE INVENTION

Figure 1:
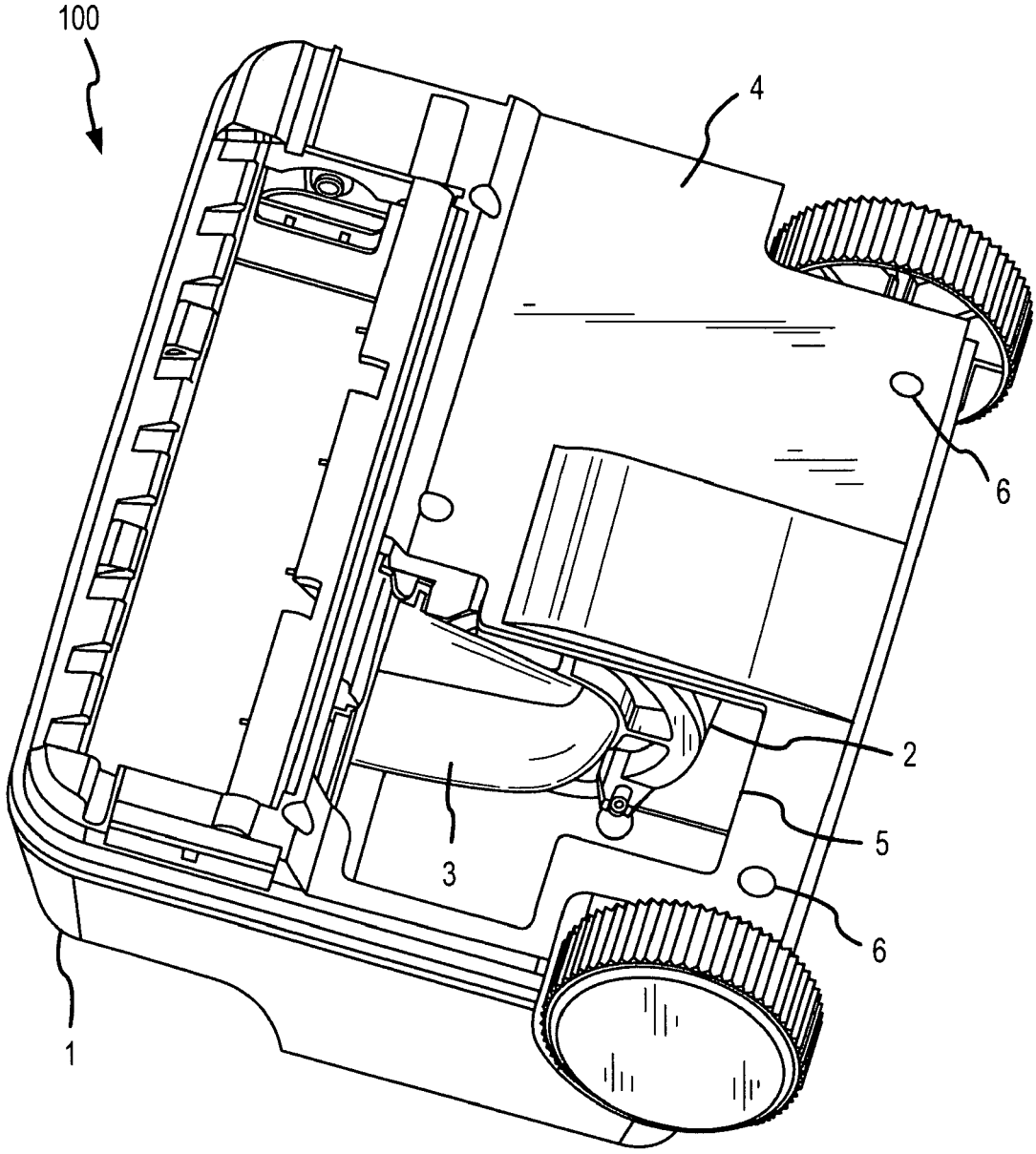
FIG. 1 is a bottom view of a vacuum cleaner according to an embodiment of the invention.

FIG. 1 is a bottom view of a vacuum cleaner 100 according to an embodiment of the invention. The vacuum cleaner 100 includes a chassis 1, a blower housing 2, an inlet housing 3, and a baseplate 4.

The vacuum cleaner shown is an upright floor model. However, it should be understood that the vacuum cleaner can be a canister, portable, shop, industrial, or specialized vacuum cleaner.

The chassis 1 includes an exterior surface and can include frame and support members to provide mounting surfaces for various components of the vacuum cleaner 100. For example, the blower housing 2 and the inlet housing 3 can be mounted to the chassis 1.

The blower housing 2 includes a motor or other rotational power source, an impeller (see FIGS. 2-4), and any necessary mounting and ducting apparatus. The blower housing 2 generates a vacuum and resulting airflow for the vacuum cleaner 100. In a dirty-air vacuum cleaner embodiment, the airflow containing dirt and debris picked up by the vacuum cleaner passes through the inlet housing 3 and the blower housing 2. As a result, the vacuum cleaner fan unit is exposed to wear and damage. Furthermore, the vacuum cleaner fan unit is therefore exposed to the possibility of congestion and clogging in heavy or unusual usage conditions, such as when picking up fibers or relatively large objects. In any vacuum cleaner embodiment, the vacuum cleaner fan unit may need periodic inspection and maintenance. The vacuum cleaner fan unit, being the heart of the air movement system, is by design located within the chassis 1 and is therefore difficult to access and inspect, much less clean or replace.

The inlet housing 3 conducts airflow into the blower housing 2. The inlet housing 3 can include any manner of geometries and any manner of inner diameters and cross sections, including the substantially 90 degree elbow embodiment shown. The geometry of the inlet housing 3, along with the internal diameter and cross-sectional shape, can determine the likelihood of clogging or restrictive blockages.

In order to clear a blockage in the inlet housing 3 (or in the blower housing 2), the inlet housing 3 will need to be partially or completely removed. When the inlet housing 3 has been partially or completely removed, any blockages or restrictions can be cleaned out. In addition, with the inlet housing 3 removed, the blower housing 2 can be inspected, cleaned, and/or serviced. In the past, such removal has typically entailed removing a baseplate or other cover, requiring tools, time, and effort. In addition, in the prior art the location of the fan unit wasn't readily determinable, and more than one access panel could be removed in order to locate the fan unit.

The baseplate 4 is a panel or panel-like member that can be part of the exterior surface of the chassis 1. The baseplate 4 can be formed of any suitable material. The purpose of the baseplate 4 is generally to enclose components of the vacuum cleaner 100 for the purpose of containing dirt, preventing mechanical components from exposure, reducing noise, and presenting a pleasant and finished appearance.

The baseplate 4 in one embodiment is formed as part of the chassis 1. In another embodiment, the baseplate 4 is a separate component that is permanently or removably attached to the chassis 1. For example, the baseplate 4 can be affixed to the chassis 1 at one or more attachment points 6, such as by suitable fasteners, including screws, rivets, clips, etc.

Although the baseplate 4 is shown as being positioned on the bottom of the vacuum cleaner 100, it should be understood that the baseplate 4 can be positioned on other locations on the vacuum cleaner 100, and the location shown is given merely for illustration.

The baseplate 4 includes an access aperture 5 that provides access to the inlet housing 3 and the blower housing 2. The access aperture 5 is of a size to allow such access and can be of any desired shape. In one embodiment, the access aperture 5 is of a size and shape to allow the inlet housing 3 to be removed from the chassis 1. In addition, the access aperture 5 can be of a size and shape to further allow removal of fasteners holding the inlet housing 3 to the blower housing 2 and allow removal of the impeller 7 of the vacuum cleaner fan unit (see FIG. 2).

The access aperture 5 in one embodiment extends substantially completely over the inlet housing 3. This access aperture embodiment enables fasteners to be removed from one or both ends of the inlet housing 3 for removal, and can enable the inlet housing 3 to slide out of the chassis (see FIG. 1).

Figure 2:
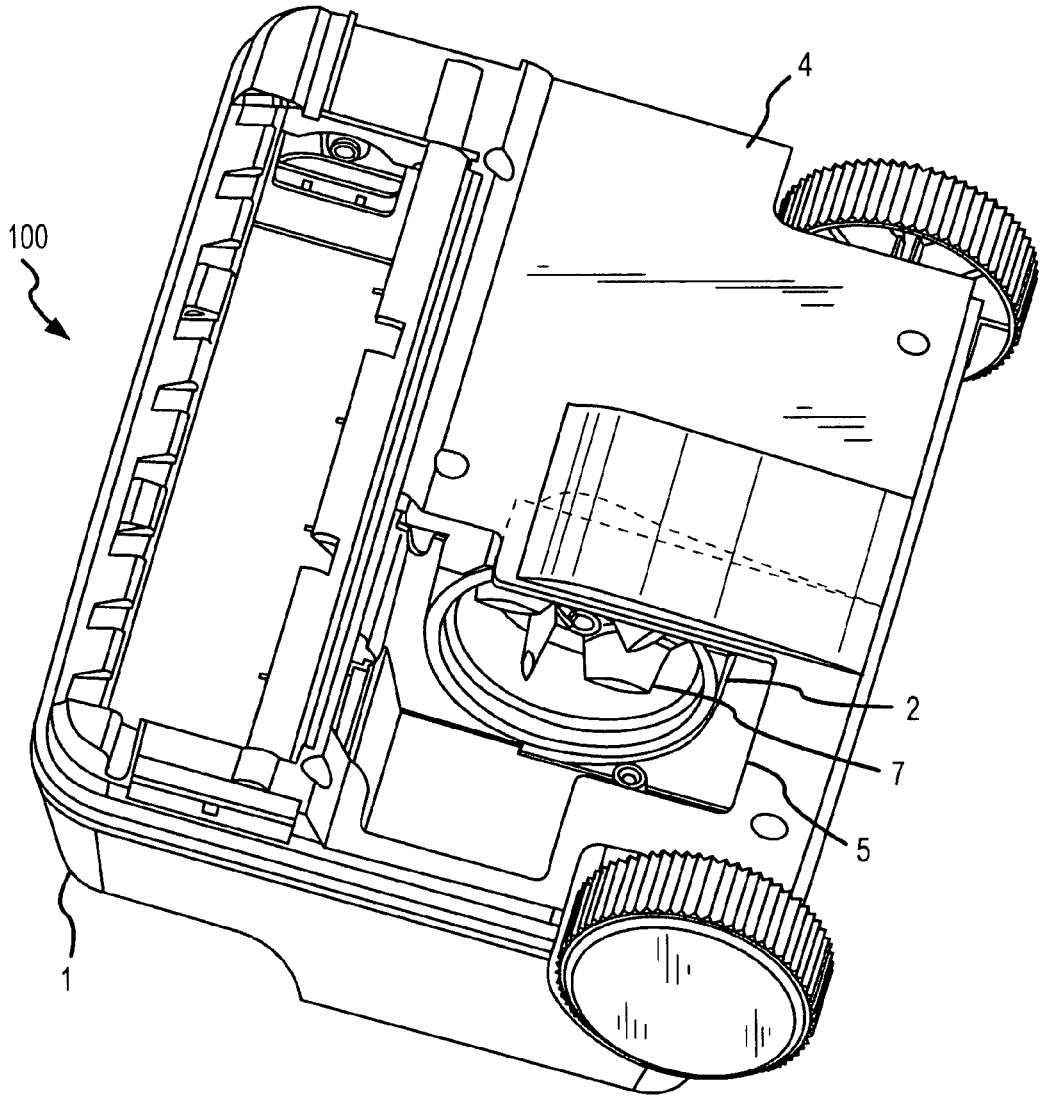
FIG. 2 shows the vacuum cleaner with the inlet housing removed.

The access aperture 5 in another embodiment extends at least partially over the inlet housing 3, and can optionally extend at least partially over the blower housing 2 (see dashed lines in FIG. 2). For example, the access aperture 5 can extend only over the fan unit end portion of the inlet housing 3, wherein fasteners, clips, or other attachment devices can be removed from the fan unit end portion and the inlet housing 3 can therefore be detached from the blower housing 2. The other end of the inlet housing 3 in such an embodiment can include tongue-and-groove fittings, lugs, dowels, etc., wherein the inlet housing 3 can be moved away from the blower housing 2 and removed after removal of only the above-mentioned fasteners.

FIG. 2 shows the vacuum cleaner 100 with the inlet housing 3 removed. The impeller 7 of the vacuum cleaner fan unit is now accessible, and can be inspected, cleaned, serviced, and/or removed. The access aperture 5 can enable the inspecting, cleaning, servicing, and/or removing. Note that the baseplate 4 has not been removed from the chassis 1.

Figure 3:
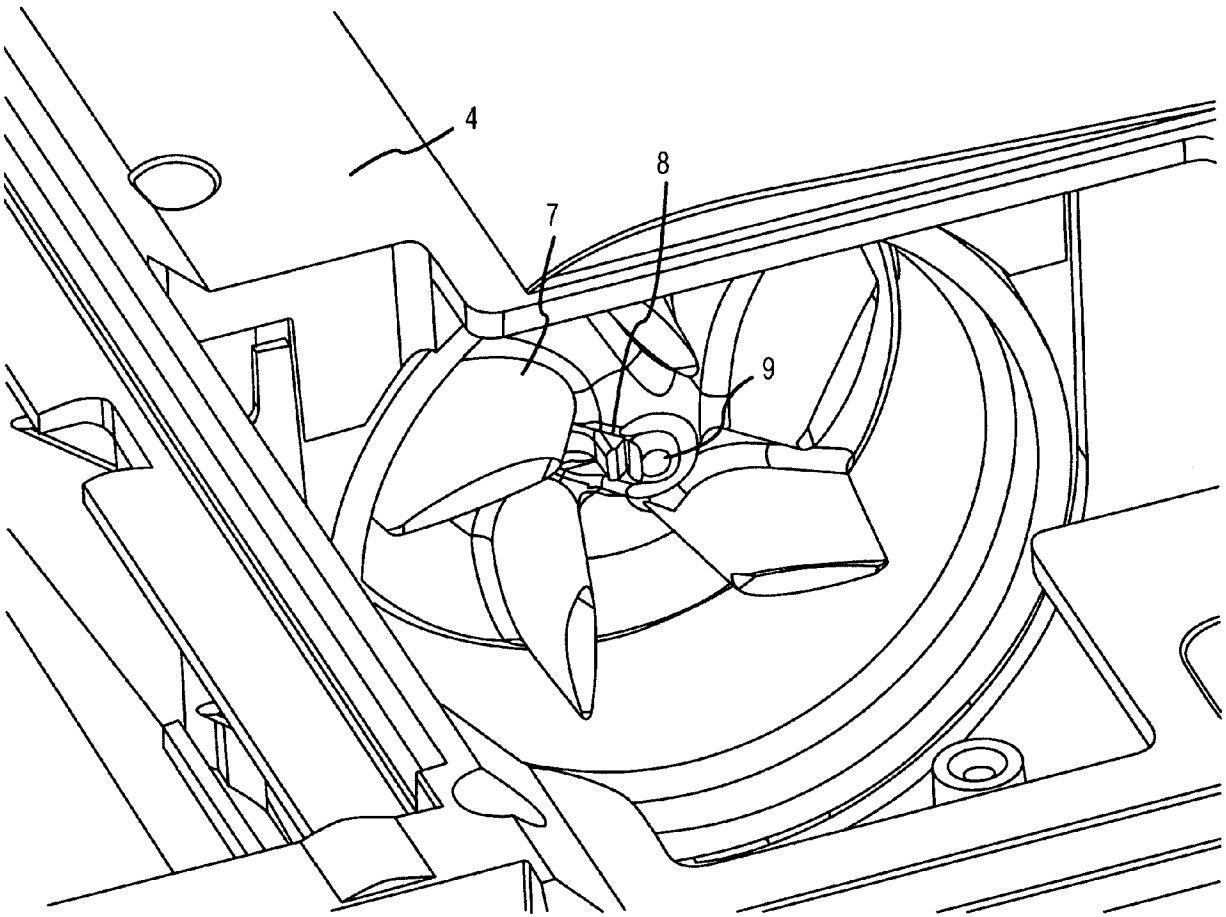
FIG. 3 shows a close-up view of an impeller and an impeller retainer as visible through an access aperture according to an embodiment of the invention.

FIG. 3 shows a close-up view of the impeller 7 and an impeller retainer S as visible through the access aperture 5 according to an embodiment of the invention. The impeller 7 in this embodiment is held to the motor of the vacuum cleaner fan unit by a biasing impeller retainer 8. The biasing retainer 8 can comprise a clip, spring clip, movable arm, etc., that is retained on the motor shaft 9 and therefore retains the impeller 7 on die motor shaft 9. The biasing retainer 8 can engage a groove, slot, keyway, etc., in the motor shaft 9. Consequently, to remove the impeller 7, the biasing retainer 8 is disengaged from the motor shaft 9. The biasing retainer 8 can be accessed and disengaged through the access aperture 5. Likewise, the impeller 7 can also be accessed and removed through die access aperture 5. In this manner, the impeller 7 can be quickly and easily removed, and without need for tools.

Figure 4:
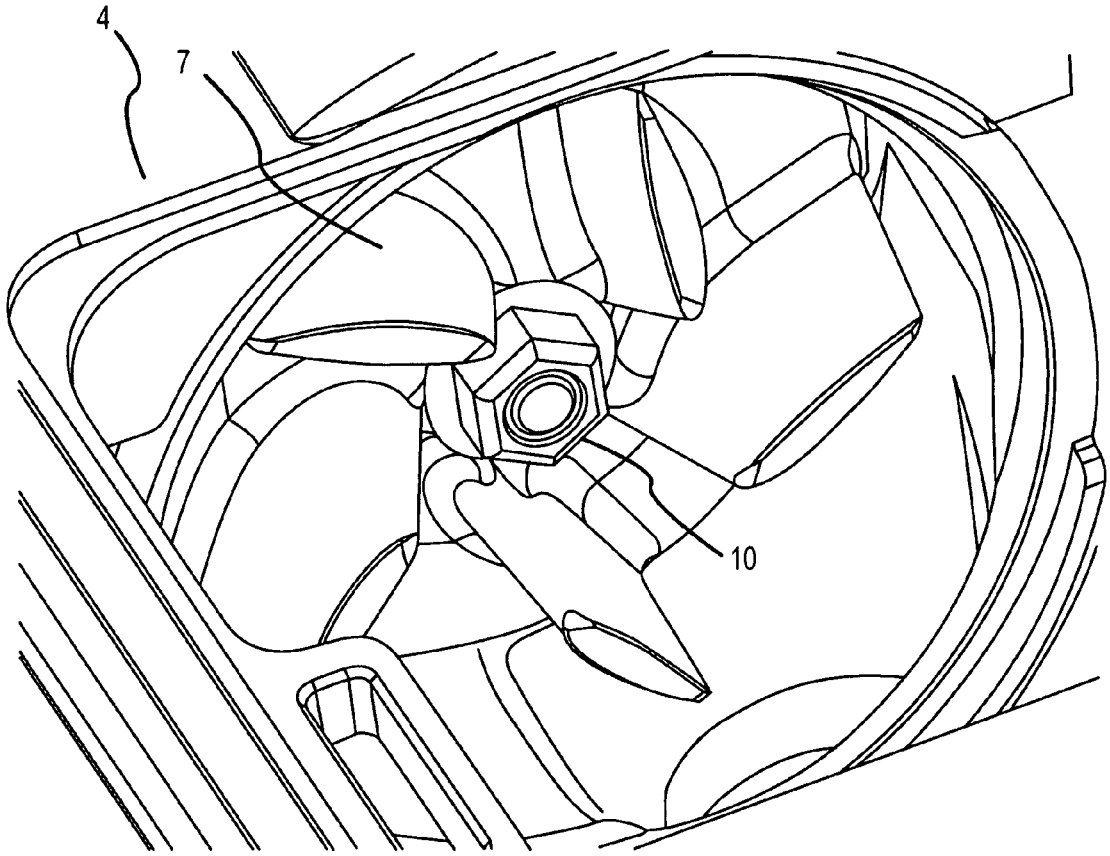
FIG. 4 shows a close-up view of another impeller retainer according to another embodiment of the invention.

FIG. 4 shows a close-up view of another impeller retainer 8 according to another embodiment of the invention. In this embodiment, the impeller is held on the motor shaft 9 by a conventional threaded retainer nut 10. Therefore, a wrench or other tool is needed to remove the impeller 7. However, the access aperture 5 provides room to access and install or remove the retainer nut 10. The access aperture 5 therefore likewise provides a valuable access capability in this embodiment.

Figure 5:
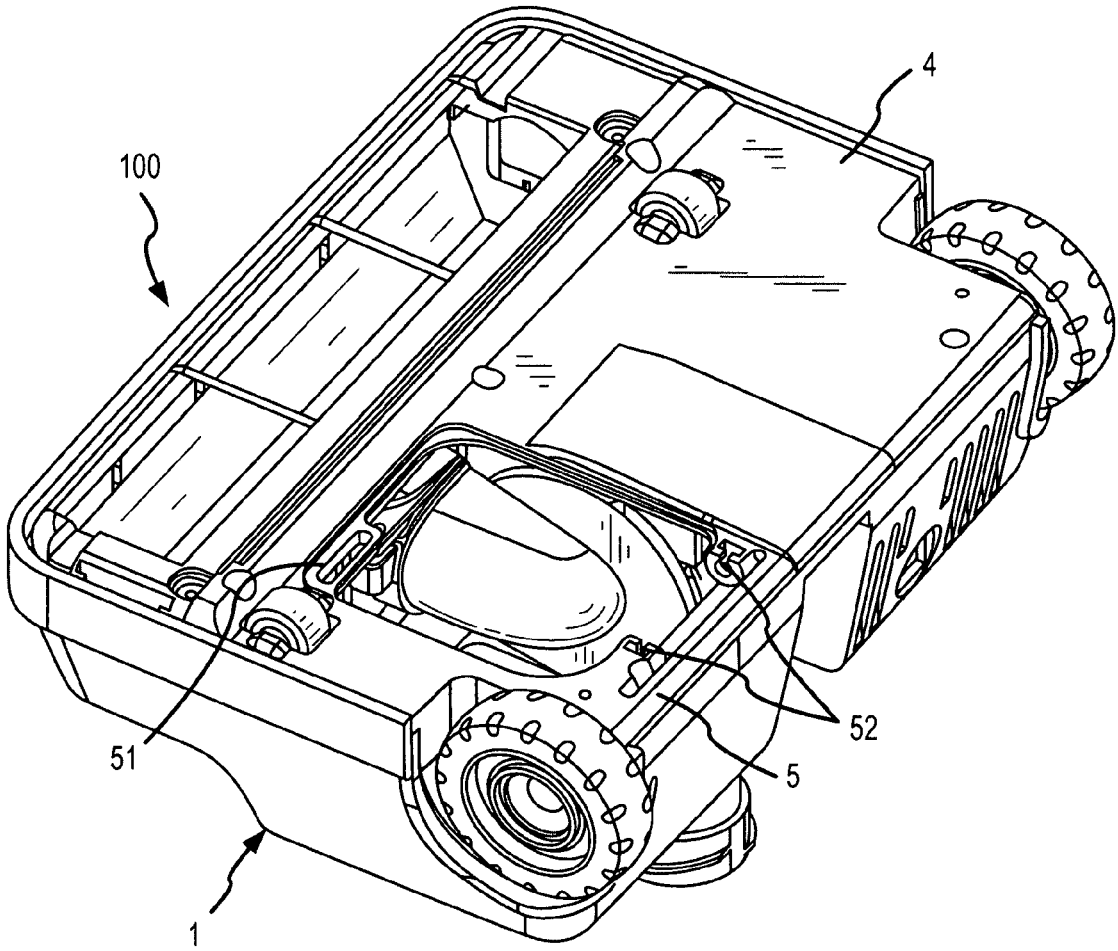
FIG. 5 shows a baseplate embodiment according to the invention that includes access door features.

FIG. 5 shows a baseplate embodiment according to the invention that includes access door features. The baseplate 4 in this embodiment includes two pivot points 52 and a fastener aperture 51. It should be understood that although two pivot points 52 are shown, other numbers of pivot points can be used, as desired. The pivot points 52 receive an axle 60 on a corresponding door 55 (see FIG. 6). The fastener aperture 51 receives a fastener 64 that holds the door 55 to the baseplate 4, wherein the door 55 substantially blocks the access aperture 5. It should be understood that alternatively the pivot points 52 can be formed on the door 55 and the axle 60 can be formed on the baseplate 4.

Figure 6:
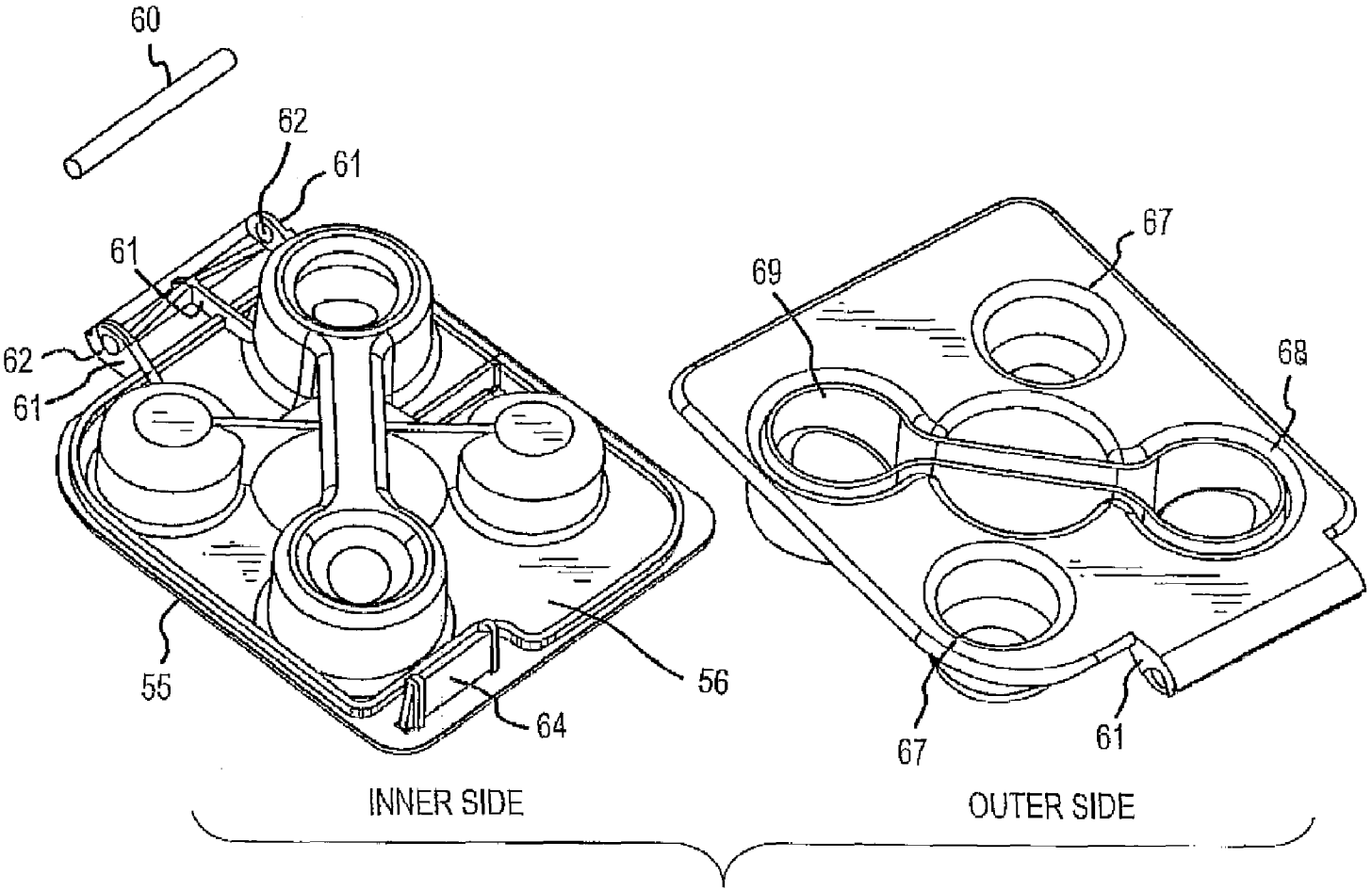
FIG. 6 shows the door according to an embodiment of the invention.

FIG. 6 shows the door 55 according to an embodiment of the invention. The door 55 can include the axle 60, standoffs 61, axle apertures 62 in the standoffs 61, the fastener 64, finger depressions 67, and a belt holder feature 68.

The axle 60 passes through the axle apertures 62 of the standoffs 61 and extends from both ends. The axle 60 engages and rotates in the pivot points 52 of the baseplate 4 (see FIG. 7). The axle 60 can comprise an individual component, as shown. Alternatively, the axle can be formed either as part of the door 55 or as part of the baseplate 4.

The fastener 64 can comprise a blade that extends from the door 55. The fastener 64 can comprise a U-shaped spring portion that is deformed when positioned in the fastener aperture 51. As a result, the fastener 64 must be displaced by a small amount in order to be inserted into and removed from the fastener aperture 51. This ensures that the door 55 is securely closed and retained against the baseplate 4. Alternatively, the fastener 64 can be retained in the fastener aperture 51 by a friction fit.

The door 55 can include one or more finger depressions 67. The finger depressions 67 extend from the underside 56 of the door 55, although it should be understood that alternatively the finger depressions 67 can be formed on and extend from the top side of the door 55 (i.e., such as substantially cylindrical rings extending from the top surface). The finger depressions 67 are of a size and shape to allow insertion of fingertips, wherein a person can grip the door 55 through use of the finger depressions 67. As a result, the door 55 can be pulled open through use of the finger depressions 67.

The door 55 can further include the belt holder feature 68. The belt holder feature 68 in one embodiment extends from the underside of the door 55, although it should be understood that alternatively the belt holder feature 68 can be formed on the top side of the door 55. The belt holder feature 68 is of a size to receive at least one spare vacuum cleaner belt 69. The belt holder feature 68 is preferably large enough so that the belt 69 fits snugly thereon. In one embodiment, the belt holder feature 68 is shaped substantially like a bone, with knobs at the ends, as shown. However, other geometries can be employed for the belt holder feature 68. One or more spare belts 69 can be retained by the belt holder feature 68 for future use.

Figure 7:
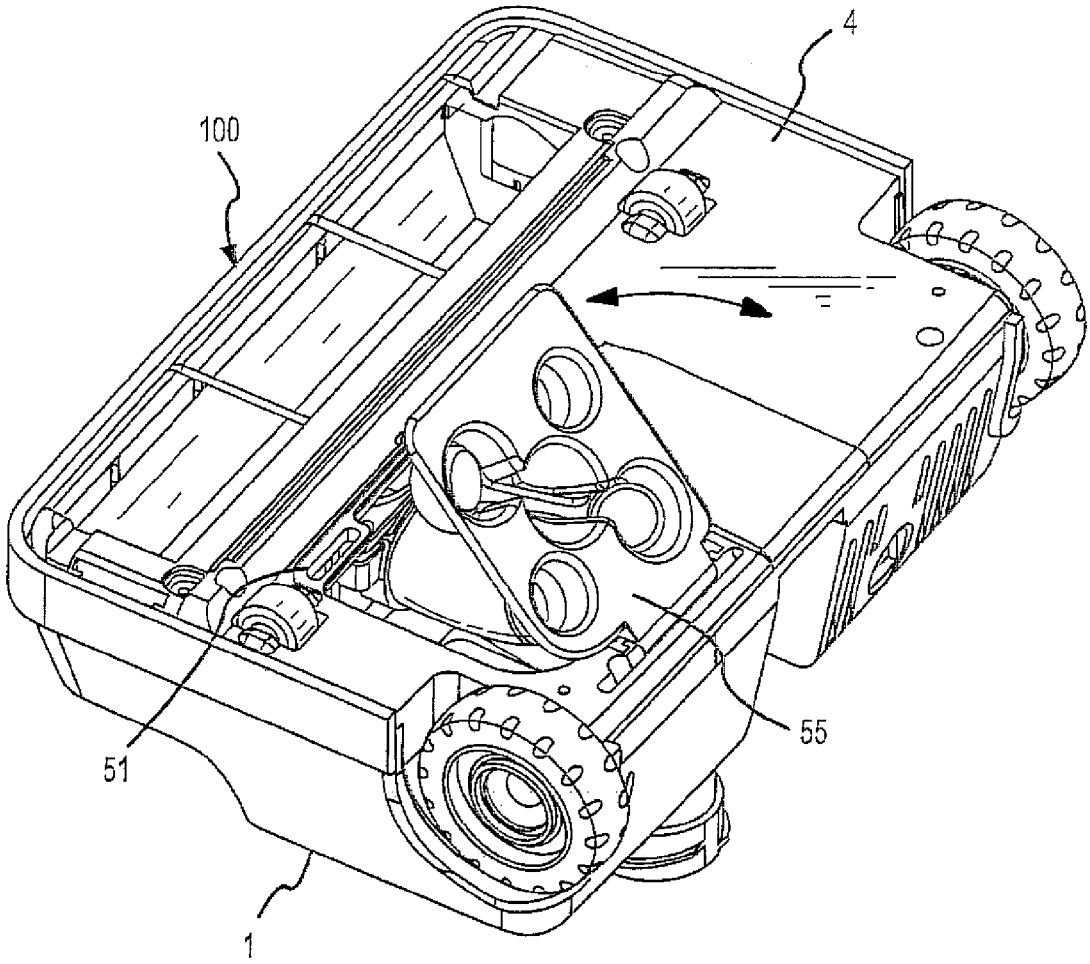
FIG. 7 shows the door of FIG. 6 when mounted to the baseplate.

FIG. 7 shows the door 55 of FIG. 6 when mounted to the baseplate 4. Here, the axle 60 is positioned in the door 55 and has been inserted into the pivot points 52 (see FIG. 5). The axle 60 can rotate in the pivot points 52 and in the door 55, and therefore the door 55 can swing open and closed, as indicated by the arrows in the figure. It should be noted that the door 55 can further be removed from the baseplate 4 by pulling the axle 60 out of the pivot points 52. The pivot points 52 can comprise slots and can be dimensionally smaller than the axle 60 (see FIG. 6), so that a predetermined amount of force is required to insert and remove the axle 60 from the pivot points 52.

Figure 8:
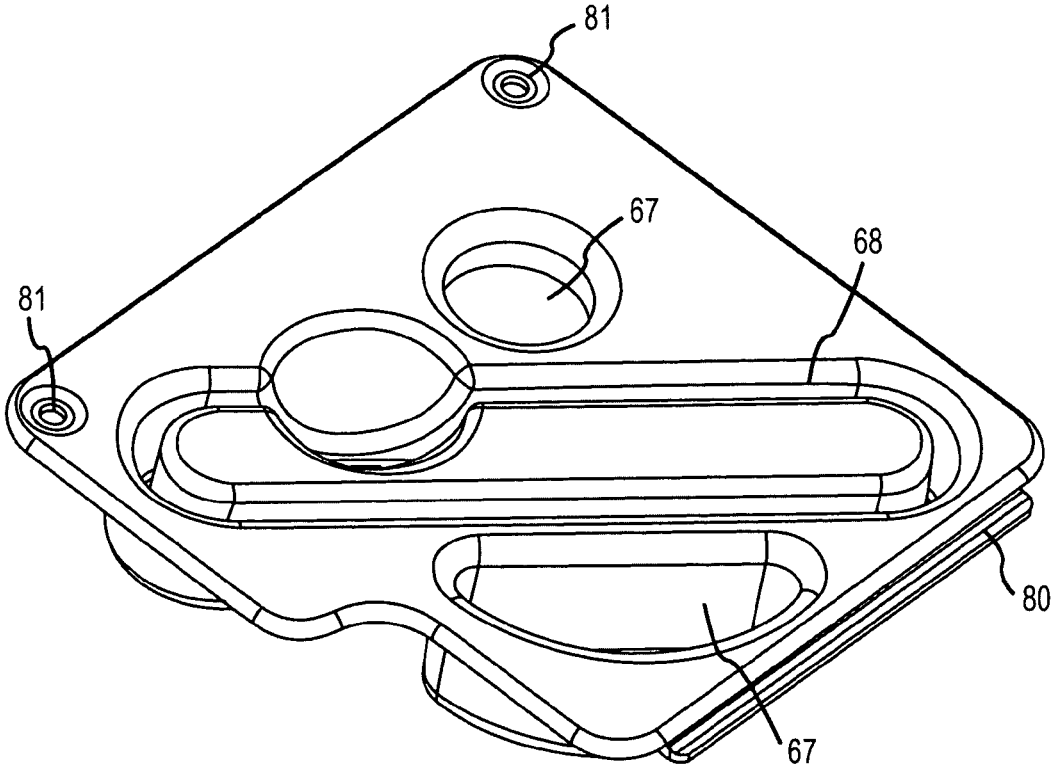
FIG. 8 shows the door according to another embodiment of the invention.

FIG. 8 shows the door 55 according to another embodiment of the invention. In this embodiment, the door 55 is held to the baseplate 4 by a tab 80 that slides under the baseplate 4 when the door 55 is placed over the access aperture 5 of the baseplate 4. The tab 80 holds one edge of the door 55 against the baseplate. The door 55 further includes one or more fastener holes 81. A fastener 84 (see FIG. 9) passes through the fastener hole 81, such as the screws shown in FIG. 9. The fasteners 84 in this embodiment cooperate with the tab 80 to hold the door 55 to the baseplate 4.

Figure 9:
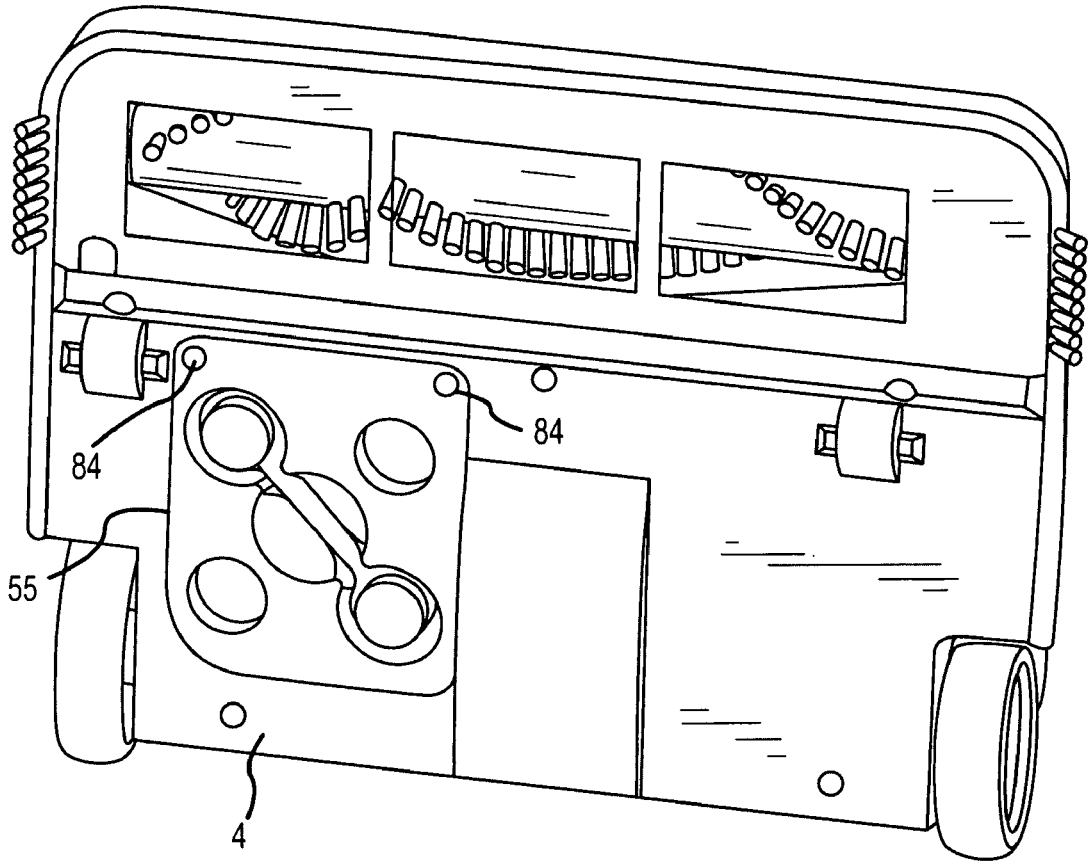
FIG. 9 shows the door of FIG. 8 when mounted to the baseplate.

FIG. 9 shows the door 55 of FIG. 8 when mounted to the baseplate 4. The fasteners 84 hold the door 55 against the baseplate 4, in cooperation with the tab 80 (not shown in this figure).

Figure 10:
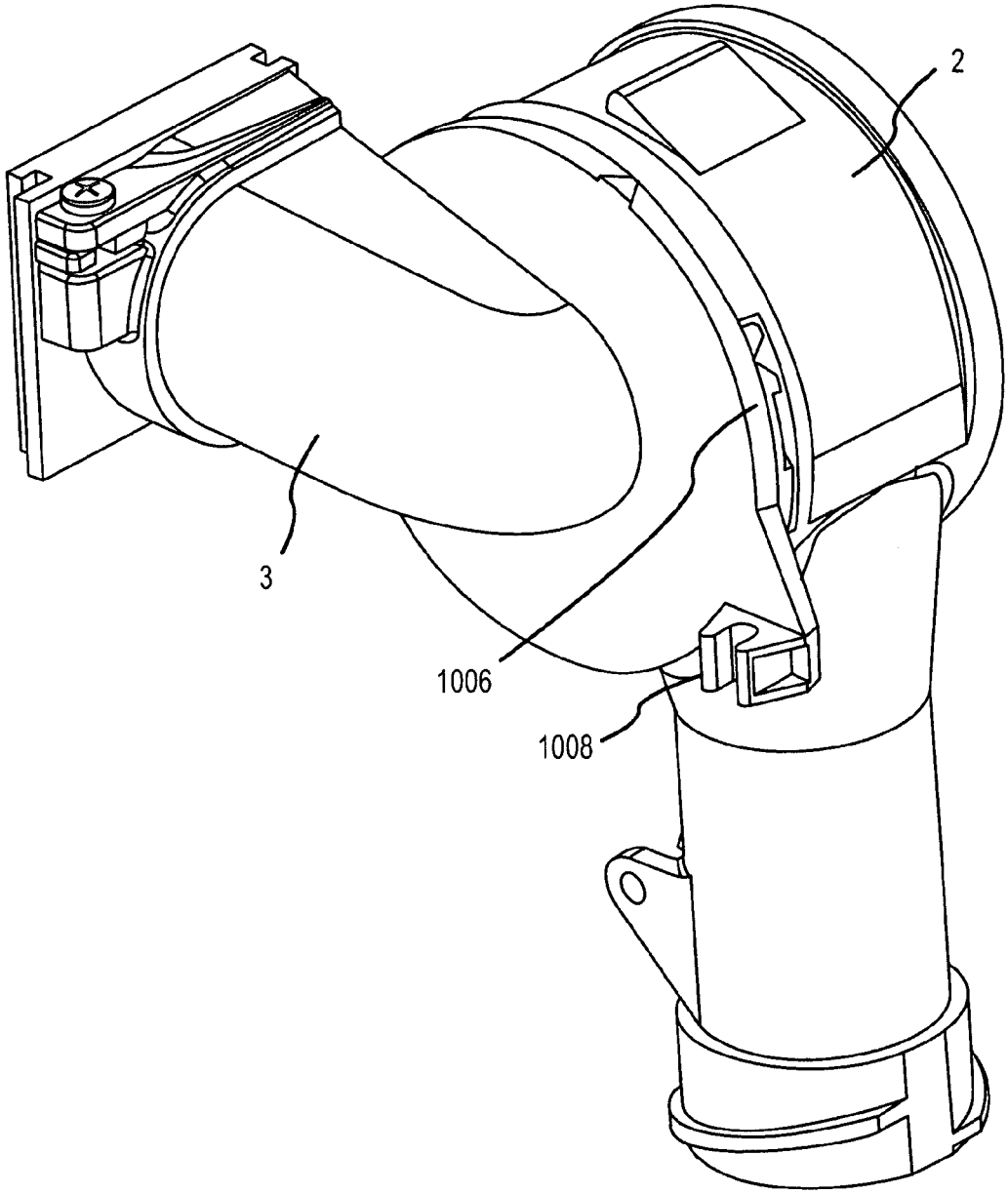
FIG. 10 shows an assembled fan unit according to an embodiment of the invention.

FIG. 10 shows an assembled fan unit according to an embodiment of the invention. The fan unit comprises an inlet housing 3, a blower housing 2, and a bearing washer 1006 (see FIGS. 11 and 12) sandwiched between the inlet housing 3 and the blower housing 2. An impeller 7 resides in the blower housing 2 (see FIG. 2). The inlet housing 3 and the bearing washer 1006 are assembled to the blower housing 2 to form a vacuum cleaner fan unit. The resulting fan unit, when the impeller 7 is powered by a motor or other power source, provides a vacuum source for the vacuum cleaner.

The inlet housing 3 in the embodiment shown includes a pair of co-located ears 1008 that cooperate with corresponding ears or holes (see FIG. 1) in the chassis 1 to removably attach the inlet housing 3 to the chassis 1. Consequently, the inlet housing 3 is held against the blower housing 2. A fastener, such as a machine bolt or screw, can be used with the pair of co-located ears 1008 to engage one or more corresponding ears or holes in the chassis 1. Assembly of the inlet housing 3 to the blower housing 2 causes a compression force that presses the inlet housing 3 against the blower housing 2. This compression force partially compresses the bearing washer 1006 between the two components, creating a substantially air-tight seal therebetween.

Figure 11:
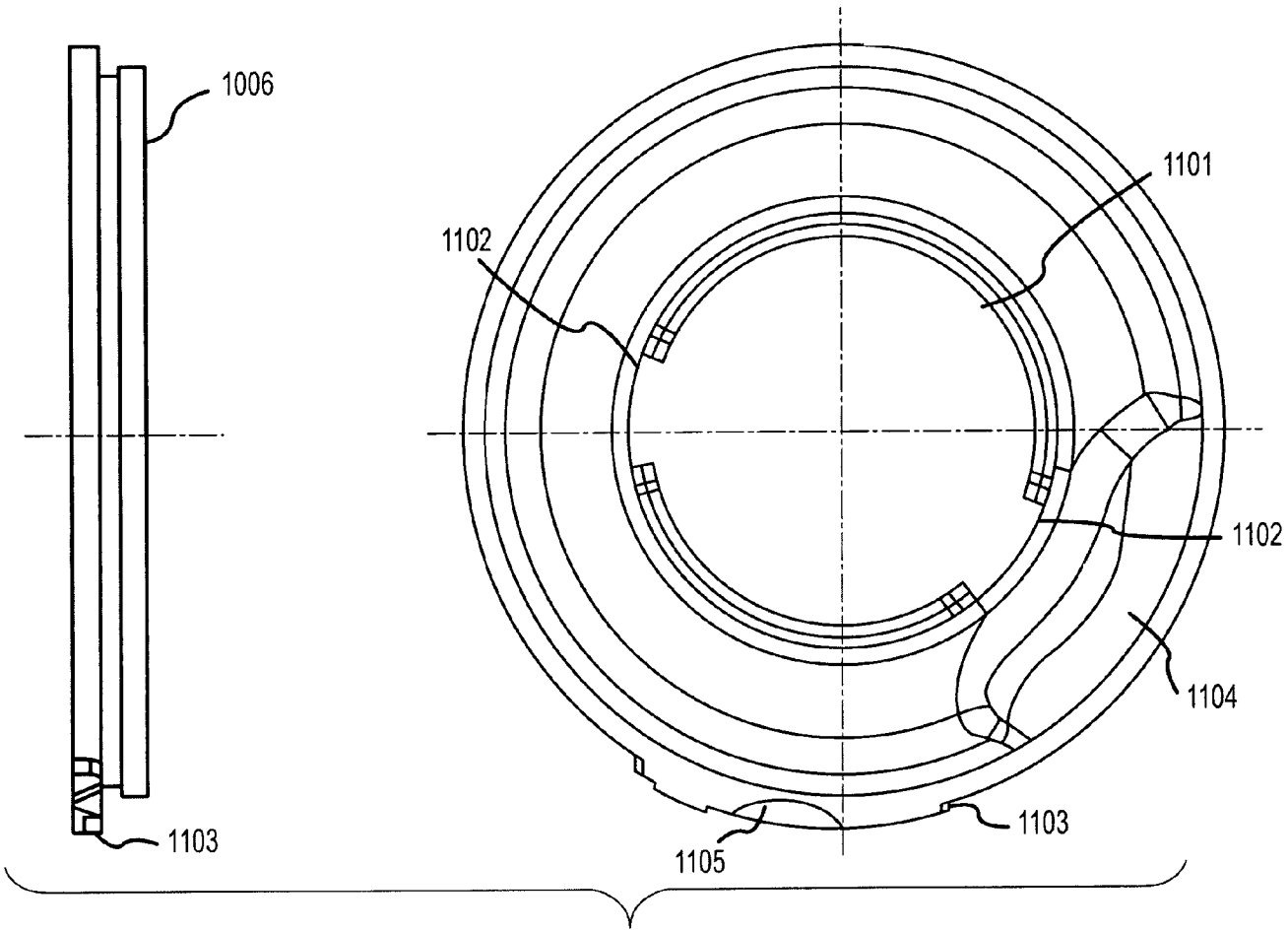
FIG. 11 shows front and side views of a bearing washer according to an embodiment of the invention.

FIG. 11 shows front and side views of the bearing washer 1006 according to an embodiment of the invention. The bearing washer 1006 includes a central aperture 1101, cutouts 1102 for corresponding ribs 1202 on the inlet housing 3 (see FIG. 12), a restraining tab 1103, and a bevel 1104. The restraining tab 1103 can include a finger cut 1105 that aids in removal of the bearing washer 1006 from the blower housing 2.

The bevel 1104 corresponds to a bulge or projection (not shown) on a blower housing bearing surface. The bulge can be included on the blower housing 2 in order to avoid sharp bends in the air channel and to avoid the resulting turbulent airflow.

The bearing washer 1006 is compressed between the inlet housing 3 and the blower housing 2 when the blower housing 2 is assembled. The bearing washer 1006 forms a substantially air-tight seal between the inlet housing 3 and the blower housing 2.

The bearing washer 1006 can be formed of a compressible material. In one embodiment, the bearing washer 1006 is formed partially or completely of a felt material. However, other compressible materials can be employed for the bearing washer 1006.

Figure 12:
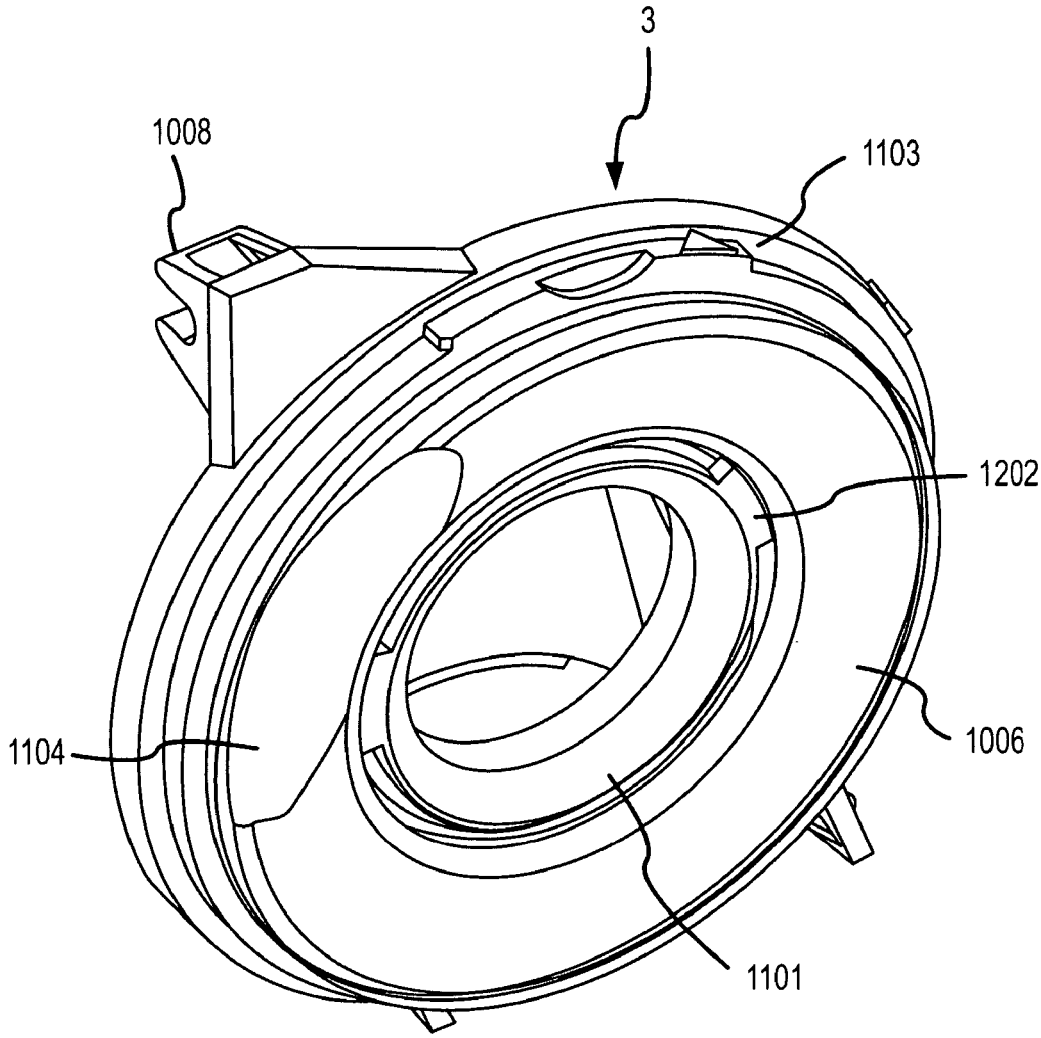
FIG. 12 shows the bearing washer assembled to an inlet housing.

FIG. 12 shows the bearing washer 1006 assembled to the inlet housing 3. Ribs 1202 of the inlet housing 3 fit in the cutouts 1102 of the bearing washer 1006, holding the bearing washer 1006 from rotating and further aligning the bearing washer 1006 with respect to the inlet housing 3. The inlet housing 3 and the bearing washer 1006 in this figure are ready to be assembled to the blower housing 2.

Figure 13:
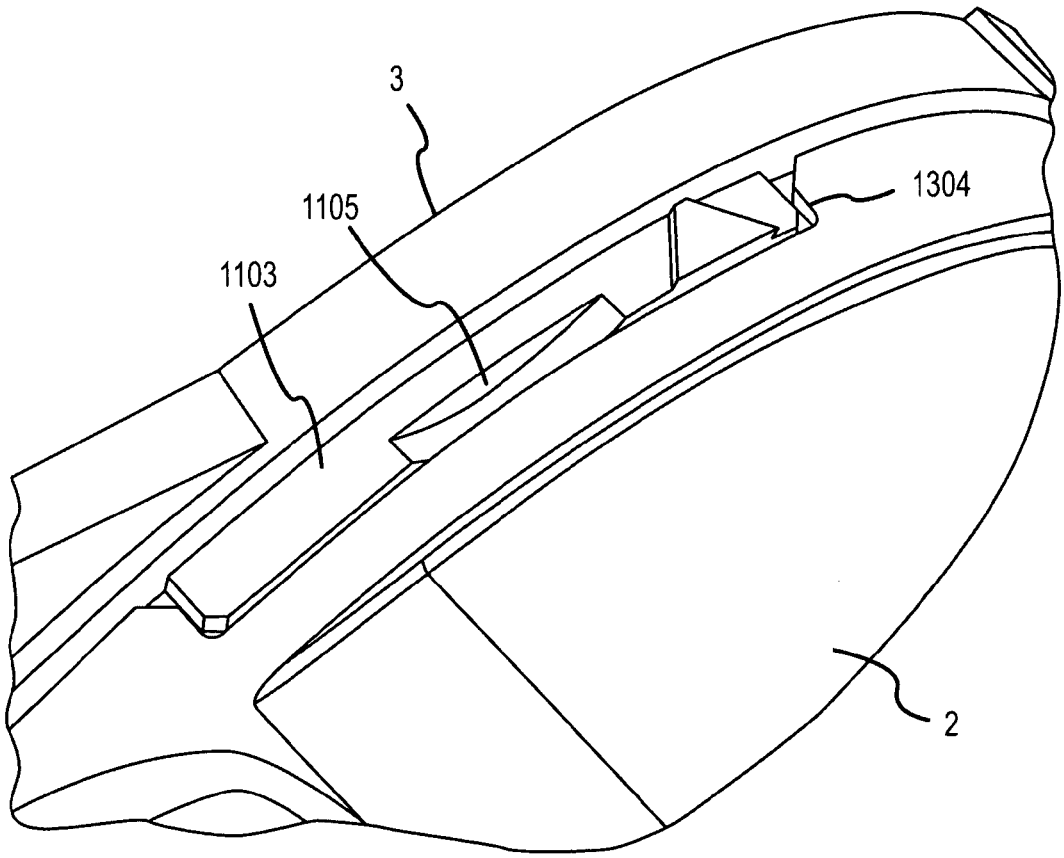
FIG. 13 shows detail of a restraining tab of the bearing washer and additionally shows a cutout in the blower housing that accepts the restraining tab.

FIG. 13 shows detail of the restraining tab 1103 of the bearing washer 1006 and additionally shows a cutout 1304 in the blower housing 2 that accepts the restraining tab 1103. The restraining tab 1103 fits in the cutout 1304 and therefore is held from rotating with respect to the blower housing 2. Consequently, the bearing washer 1006 is not free to rotate with respect to the blower housing 2.

Figure 14:
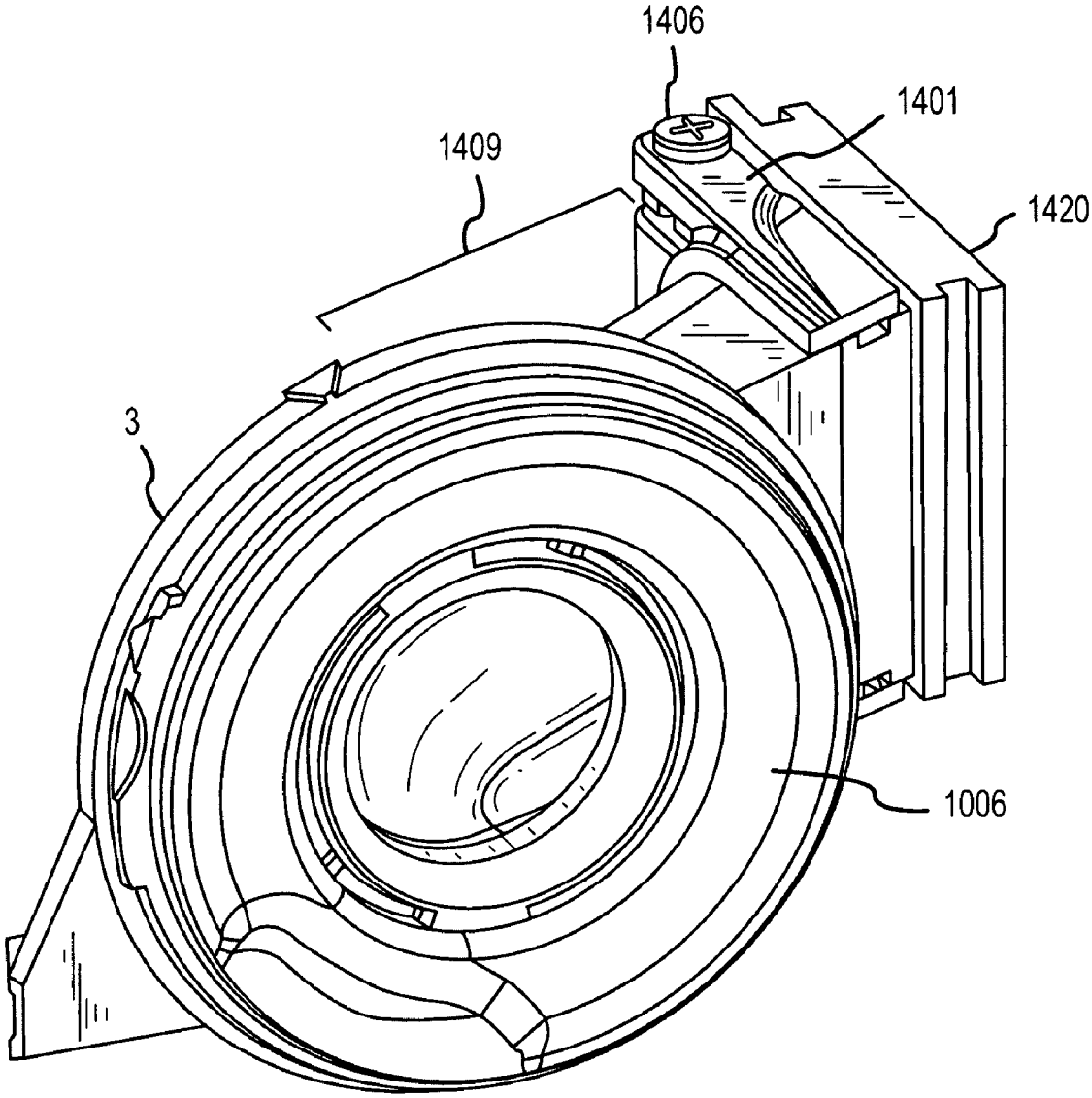
FIG. 14 shows detail of the inlet housing according to an embodiment of the invention.

FIG. 14 shows detail of the inlet housing 3 according to an embodiment of the invention. In the embodiment shown, the inlet housing 3 includes an inlet conduit portion 1409, a slide flange 1401 formed on an end of the inlet conduit portion 1409, and a slide block 1420 that interacts with the slide flange 1401.

Figure 15:
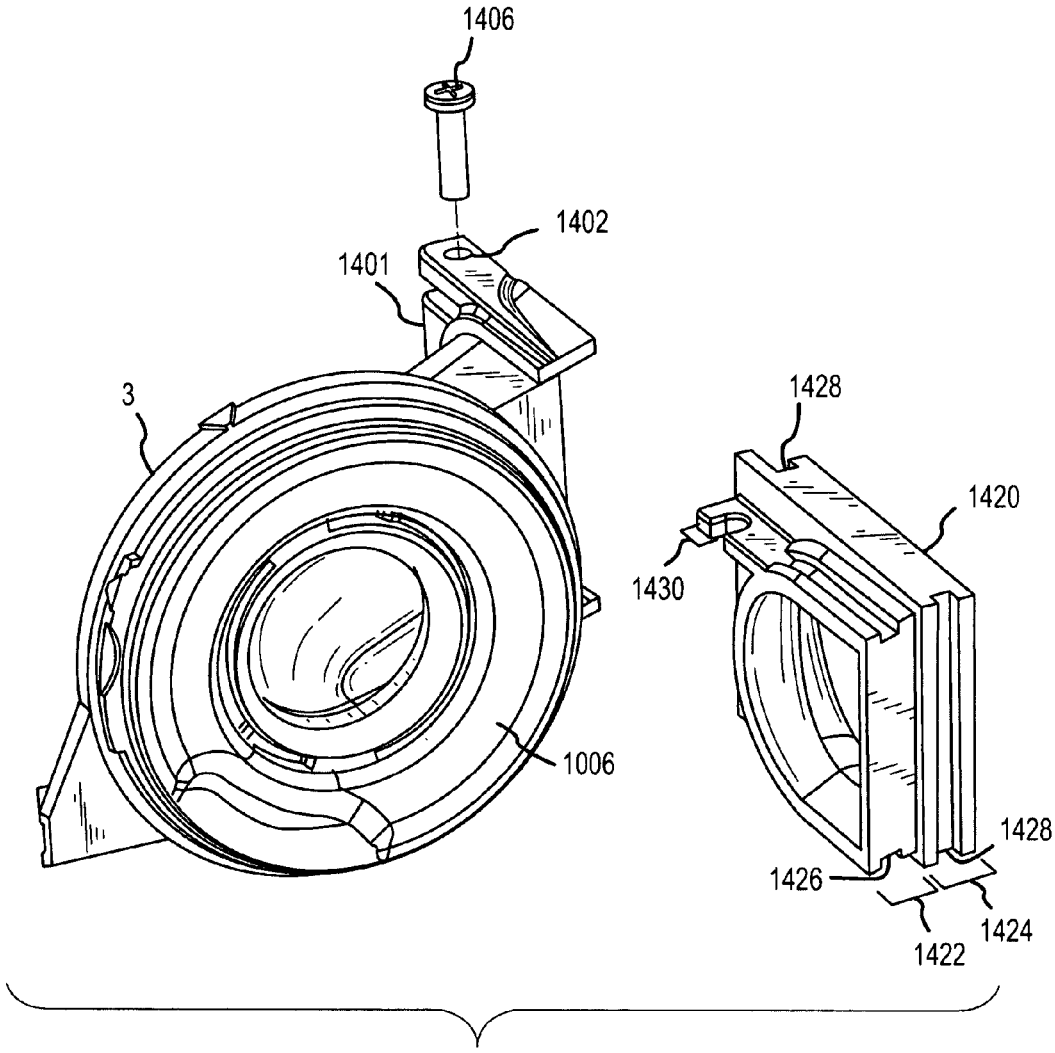
FIGS. 15 and 16 show exploded views of the inlet housing and a slide block.
Figure 16:
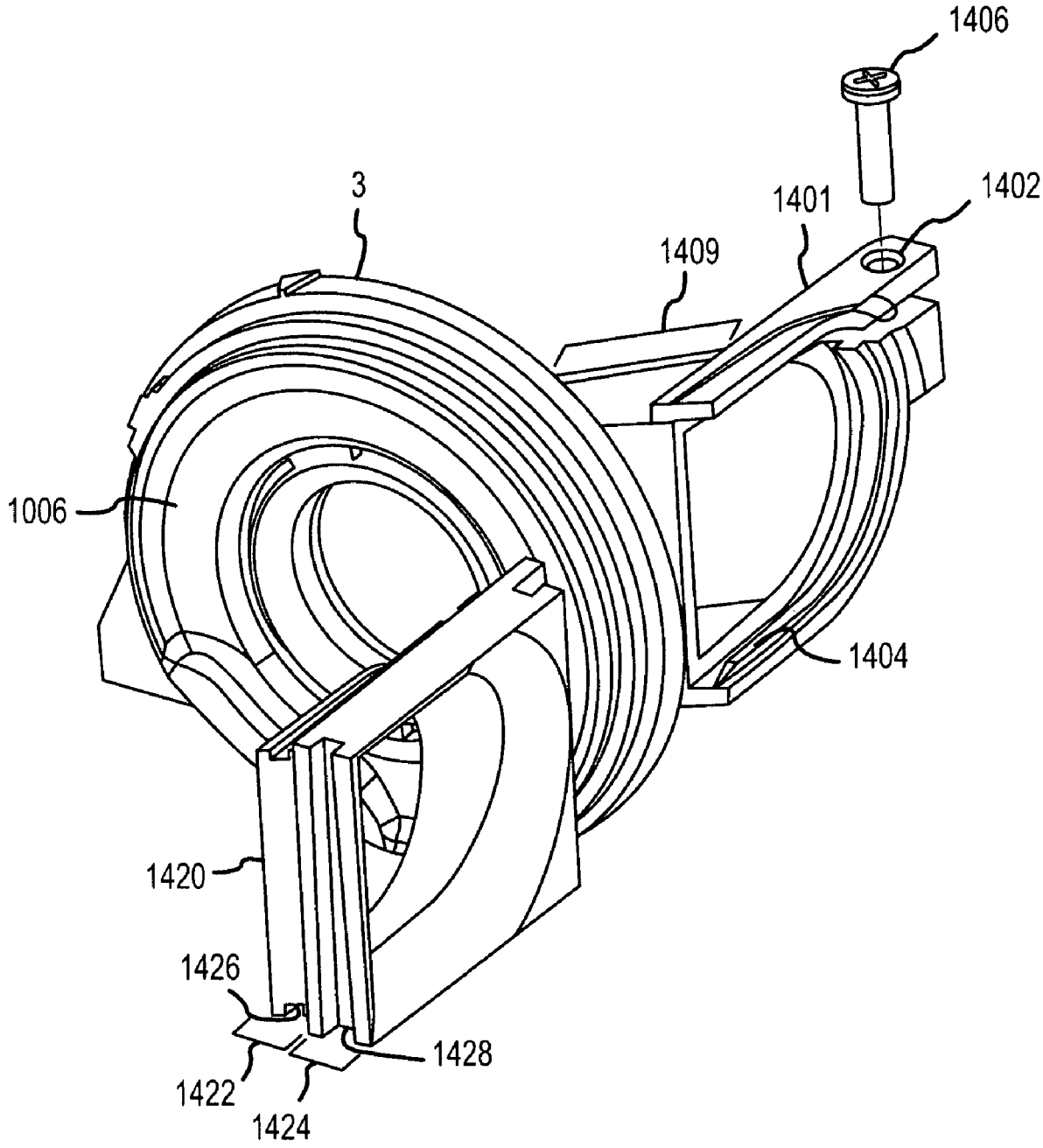

FIGS. 15 and 16 show exploded views of the inlet housing 3 and the slide block 1404. These two figures illustrate how the slide block 1404 slides into and engages the slide flange 1401.

The slide flange 1401 includes at least one rib 1404 (see FIG. 16). The at least one rib 1404 can be formed on an inner edge of the inlet conduit portion 1409. The at least one rib 1404 enables the slide block 1420 to be slidably held in the slide flange 1401.

The slide flange 1401 further includes a fastener aperture 1402. A fastener 1406 can pass through the fastener aperture 1402 and can further pass through a corresponding fastener slot 1430 (or aperture) in the slide block 1404.

The slide block 1420 includes an inlet portion 1422 and a chassis portion 1424. The inlet portion 1422 includes at least one groove 1426 formed on the surface of the inlet portion 1422. The at least one groove 1426 corresponds to the at least one rib 1404. When the inlet portion 1422 is in position in the slide flange 1401, the slide block 1420 cannot be disengaged unless the slide block 1420 is slid back out of the slide flange 1401.

The inlet portion 1422 further includes the fastener slot 1430 that receives the fastener 1406. The fastener 1406 passes Through the fastener slot 1430 and thereby retains the slide block 1420 in the slide flange 1401 (see FIG. 14). It should be understood that alternatively the fastener slot 1430 can be closed (i.e., it can comprise a hole or aperture).

The fastener 1406 can comprise any type of fastener capable of affixing the slide flange 1401 to the slide block 1420. In one embodiment, for example, the fastener 1406 is a threaded fastener. As a result, the fastener 1406 can comprise a screw or bolt. Alternatively, the fastener 1406 can comprise any manner of pin, spring, spring clip, etc.

The chassis portion 1424 of the slide block 1420 includes at least two grooves 1428 formed on the surface of the chassis portion 1424. The at least two grooves 1428 engage rails, ribs, or flanges in the chassis 1. The at least two grooves 1428 therefore enable the chassis portion 1424 to slide into and engage the chassis 1 and removably affix the slide block 1420 to the chassis 1.

When assembled, the slide block 1420 slides into and engages the slide flange 1401. The slide block 1420 further slides into and engages the chassis 1. The slide block 1420 can slide into and engage the chassis rails, ribs, or flanges in order to removably affix the inlet housing 3 to the chassis 1. The slide block 1404 can be retained in the chassis 1 by the baseplate 4 (see FIG. 1). Consequently, the inlet housing is held in the chassis 1 by the slide block 1420 in conjunction with a fastener that engages the ears 1008 (see FIG. 10) of the inlet housing 3. It should be noted that the baseplate 4 does not prevent the inlet housing 3 from being disengaged from the slide block 1420.

In another embodiment (not shown), the slide flange 1401 slides directly into and engages the rails, ribs, or flanges of the chassis 1. In this embodiment, the fastener 1406 can engage an ear, tab, or lug that extends from the chassis 1. This slide block 1420 is not needed in this embodiment.

The access aperture 5 according to any embodiment of the invention provides several benefits. The access aperture 5 provides easy access to inlet housing 3 and easy access to the blower housing 2. The access aperture 5 further provides easy removal of the inlet housing 3 from the chassis 1 and provides easy removal of the impeller 7 from the blower housing 2 and the chassis 1. The access aperture 5 moreover enables removal of dirt and/or clogs and permits visual inspection of the fan unit region.

Another benefit is that an impeller retainer 8 and impeller 7 can be easily accessed and removed. A biasing impeller retainer 8 on the motor shaft 9 allows quick and easy removal of the impeller 7 without need for tools. Alternatively, a conventional threaded nut 10 can also be accessed and removed.

The door 55 can be easily and quickly opened. The door 55 can seal the baseplate 4 and yet can provide convenient access to the vacuum cleaner fan unit.

The vacuum cleaner fan unit according to any embodiment of the invention also provides several benefits. The vacuum cleaner fan unit enables easy and fast insertion and removal of the inlet housing 3. This enables access to the impeller 7 and the blower housing 2. The assembled inlet housing 3 and bearing washer 1006 form a substantially airtight seal with the blower housing 2.

What is claimed is:

1. A vacuum cleaner, comprising:

a chassis;

a blower housing mounted to the chassis;

an inlet housing removably affixed to the blower housing; and a baseplate affixed to the chassis and including a vacuum intake nozzle and an access aperture formed in the baseplate, wherein the access aperture extends at least partially over the inlet housing and wherein an outer portion of the inlet housing can be accessed through the access aperture.

2. The vacuum cleaner of claim 1, wherein the blower housing can also be accessed though the access aperture.

3. The vacuum cleaner of claim 1, wherein the access aperture further extends at least partially over the blower housing.

4. The vacuum cleaner of claim 1, wherein the access aperture is of a size and shape to allow the inlet housing to be removed from the chassis though the access aperture.

5. The vacuum cleaner of claim 1, wherein the access aperture is of a size and shape to allow an impeller to be removed from the blower housing and from the chassis though the access aperture.

6. The vacuum cleaner of claim 1, wherein the baseplate is removably affixed to the chassis.

7. The vacuum cleaner of claim 1, wherein the blower housing includes a motor and an impeller removably attached to the motor by a retainer nut.

8. The vacuum cleaner of claim 1, wherein the blower housing includes a motor and an impeller removably attached to the motor by a biasing retainer.

9. The vacuum cleaner of claim 1, further comprising:

a door including open and closed positions, with the door substantially blocking the access aperture when in the closed position; and two or more fastener devices that removably affix the door to the baseplate when the door is in the closed position.

10. A vacuum cleaner, comprising:

a chassis;

a blower housing mounted to the chassis;

an inlet housing removably affixed to the blower housing;

a baseplate affixed to the chassis and including an access aperture formed in the baseplate, wherein the access aperture extends at least partially over the inlet housing and wherein the inlet housing can be accessed through the access aperture;

a door including open and closed positions, with the door substantially blocking the access aperture when in the closed position; and two or more fastener devices that removably affix the door to the baseplate when the door is in the closed position.

11. The vacuum cleaner of claim 10, with a particular fastener of the two or more fastener devices comprising:

two slots formed in the baseplate;

a substantially cylindrical tube extending at least partially along an edge of the door; and an axle passing through the tube and positioned in the two slots;

wherein the axle snaps into the slot and the axle is free to rotate in either the slot or in the tube.

12. The vacuum cleaner of claim 10, wherein a particular fastener of the two or more fastener devices comprises a blade and a fastener aperture formed in the baseplate, wherein the blade passes through and engages the fastener aperture when the door is substantially closed against the baseplate.

13. The vacuum cleaner of claim 10, wherein the two or more fasteners comprise a tab and one or more holes in the door and one or more corresponding holes in the baseplate, wherein the tab engages and fits under an edge of the access aperture of the baseplate and one or more screws pass through the door and the baseplate through the one or more holes.

14. The vacuum cleaner of claim 10, further comprising one or more finger depressions formed in the door.

15. The vacuum cleaner of claim 10, further comprising a belt holder feature formed in the door.

16. The vacuum cleaner of claim 10, wherein the blower housing can also be accessed through the access aperture.

17. The vacuum cleaner of claim 10, wherein the access aperture further extends at least partially over the blower housing.

18. The vacuum cleaner of claim 10, wherein the access aperture is of a size and shape to allow the inlet housing to be removed from the chassis through the access aperture.

19. The vacuum cleaner of claim 10, wherein the access aperture is of a size and shape to allow an impeller to be removed from the blower housing and from the chassis through the access aperture.

20. The vacuum cleaner of claim 10, wherein the baseplate is removably affixed to the chassis.

21. The vacuum cleaner of claim 10, wherein the blower housing includes a motor and an impeller removably attached to the motor by a retainer nut.

22. The vacuum cleaner of claim 10, wherein the blower housing includes a motor and an impeller removably attached to the motor by a biasing retainer.

* * * * *